US006478164B1

(12) United States Patent
Pan

(10) Patent No.: US 6,478,164 B1
(45) Date of Patent: Nov. 12, 2002

(54) ANIMATED LIGHT SUPPORTING DISPLAY WITH UP AND DOWN HEAD MOVEMENT

(76) Inventor: Wen-Hua Pan, 7th Floor #285, Section 4, Chung Hsiao East Road, Taipei (TW)

( * ) Notice: Subject to any disclaimer, the term of this patent is extended or adjusted under 35 U.S.C. 154(b) by 78 days.

(21) Appl. No.: 09/817,383

(22) Filed: Mar. 27, 2001

Related U.S. Application Data

(60) Provisional application No. 60/218,839, filed on Jul. 18, 2000.

(51) Int. Cl.[7] ..... A47F 3/08

(52) U.S. Cl. ..... 211/1.51; 211/26; 211/181.1; D11/127; 428/8; 428/7; 428/9; 362/252; 40/414

(58) Field of Search ..... 211/1.51, 181.1, 211/26, 1.57; 248/7, 8, 12; D11/127, 158, 159; 40/411, 414, 418, 421, 423; 362/252; 428/7, 8, 12, 9

(56) References Cited

U.S. PATENT DOCUMENTS 4,867,730 A * 9/1989 Lee
5,393,259 A * 2/1995 Lee ..... 40/414 X
5,584,741 A * 12/1996 Cheung ..... 40/414 X
5,766,701 A * 6/1998 Lee ..... 428/9
5,784,815 A * 7/1998 Hermanson ..... 40/414
5,850,927 A 12/1998 Pan
6,180,193 B1 * 1/2001 Bostedt ..... 428/7
6,394,282 B1 * 5/2002 Pan ..... 211/1.51
6,413,594 B1 * 7/2002 Onishi ..... 428/7

FOREIGN PATENT DOCUMENTS

CN ZL96236724.9 9/1997

* cited by examiner

*Primary Examiner*—Robert W. Gibson, Jr.
(74) *Attorney, Agent, or Firm*—Donald A. Keitlestrings

(57) ABSTRACT

An animated light sculpture framework is configured for enabling the framework to be quickly and easily unfolded and erected for use and to be quickly and easily folded together into a compact configuration for transport and/or storage. A head and neck portion of the light sculpture framework is vertically movable in an oscillating manner to simulate natural movement by use of a motor connected to the framework and a counterweight operably positioned between the head and neck portion and the motor.

14 Claims, 2 Drawing Sheets

ANIMATED LIGHT SUPPORTING DISPLAY WITH UP AND DOWN HEAD MOVEMENT

This application claims the benefit of provisional application No. 60/218,839, filed Jul. 18, 2000.

BACKGROUND OF THE INVENTION

This invention relates to an animated light sculpture framework and more particularly to an animated, free-standing, collapsible, three-dimensional wire framework and light supporting display for use as a decorative light sculpture wherein the head and neck portions of the display are moved up and down in an oscillating manner.

U.S. Pat. No. 5,850,927 is incorporated by reference into this application, as provided by Manual of Patent Examining Procedure, Section 608.01(p). Particular attention is directed to the drawings and specification of U.S. Pat. No. 5,850,927 where the subject matter being incorporated may be found. Further, the reference numerals used in U.S. Pat. No. 5,850,927 to identify various elements of the invention described therein are also used herein to identify identical elements found in this invention.

It is an object of the present invention to provide an animated, free-standing, three-dimensional, collapsible wire framework and light supporting display for use as a light sculpture wherein the head and neck portions of the display are moved up and down in an oscillating manner.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects, the present invention provides an animated, three-dimensional wire framework and light supporting display comprising: a first wire frame assembly defining a first predetermined portion of a figure; an additional wire frame assembly defining an additional predetermined portion of the figure, the additional frame assembly hingedly connected to the first frame assembly; at least one support defining a further predetermined portion of the figure, the support connected to the first frame assembly; a motor connected to the first frame assembly; a first arm member connected to and extending from the motor for rotation in response to activation of the motor; a second arm member defining first and second ends, the first end rotatably attached to the first arm member; a counterweight having a first receptacle connected thereto; the second end of the second arm member rotatably positioned within the first receptacle; a third arm member attached to and projecting from the counterweight, the third arm member defining a distal end; a second receptacle attached to the additional wire frame assembly; and the distal end of the third arm member positioned within the second receptacle, whereby activation of the motor causes substantially up and down movement of the additional wire frame assembly.

It is to be understood that both the foregoing general description and the following detailed description are exemplary and explanatory but are not restrictive of the invention.

BRIEF DESCRIPTION OF THE SEVERAL VIEWS OF THE DRAWINGS

The accompanying drawings, which are incorporated in and constitute a part of this specification, illustrate a preferred embodiment of the invention and, together with the description, serve to explain the principles of the invention.

DETAILED DESCRIPTION OF THE INVENTION

Figure 1:
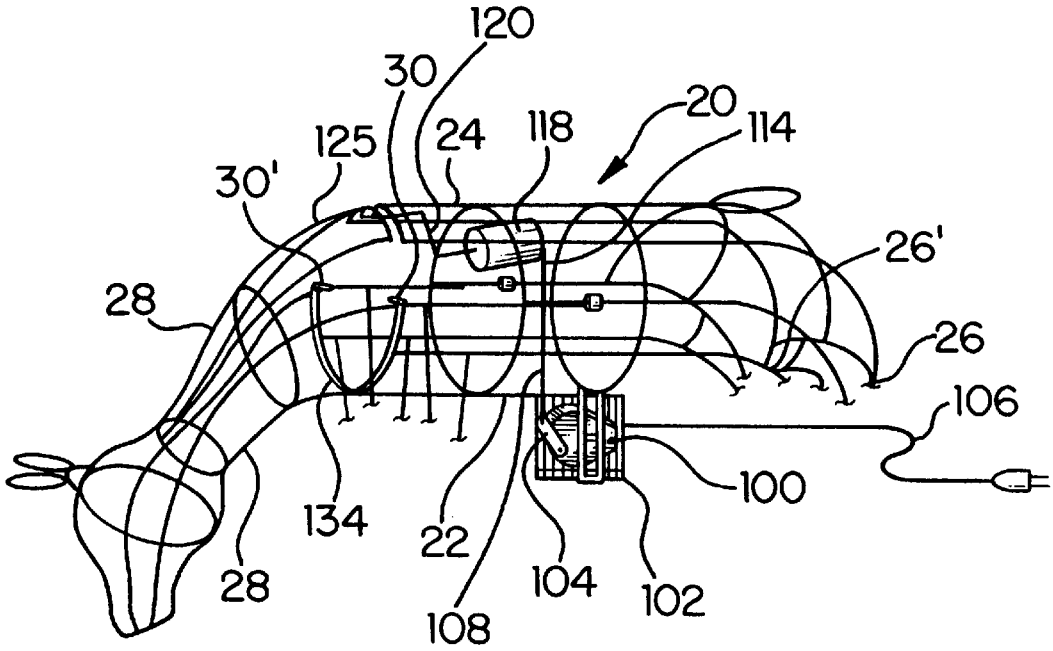
FIG. 1 is a fragmentary perspective view of the invention showing the head and neck portion of the display in a downward position.
Figure 2:
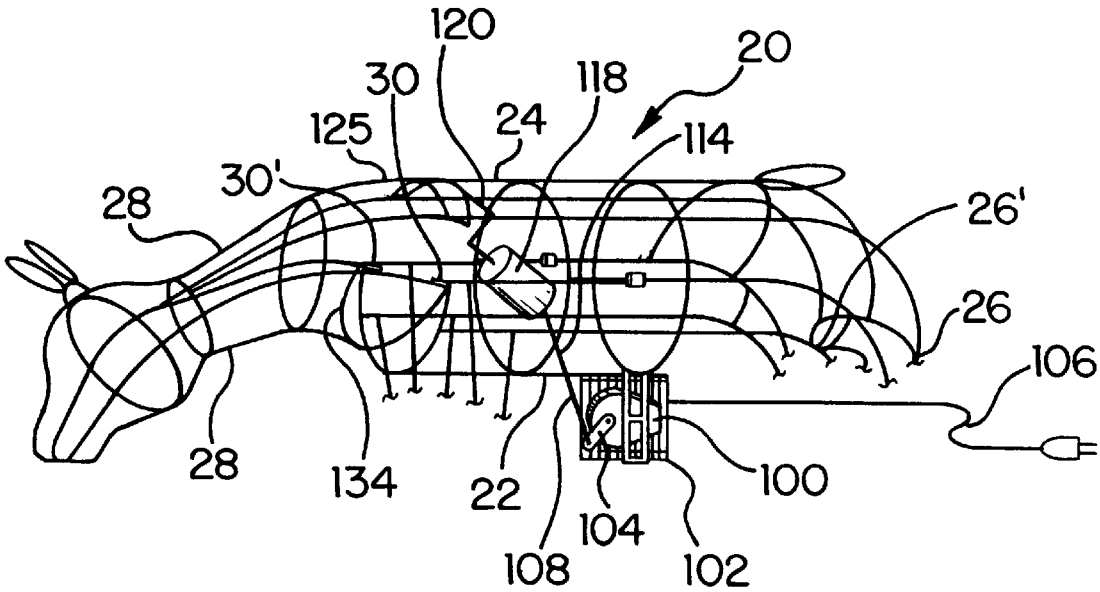
FIG. 2 is a fragmentary perspective view of the invention showing the head and neck portion of the display in an upward position.
Figure 3:
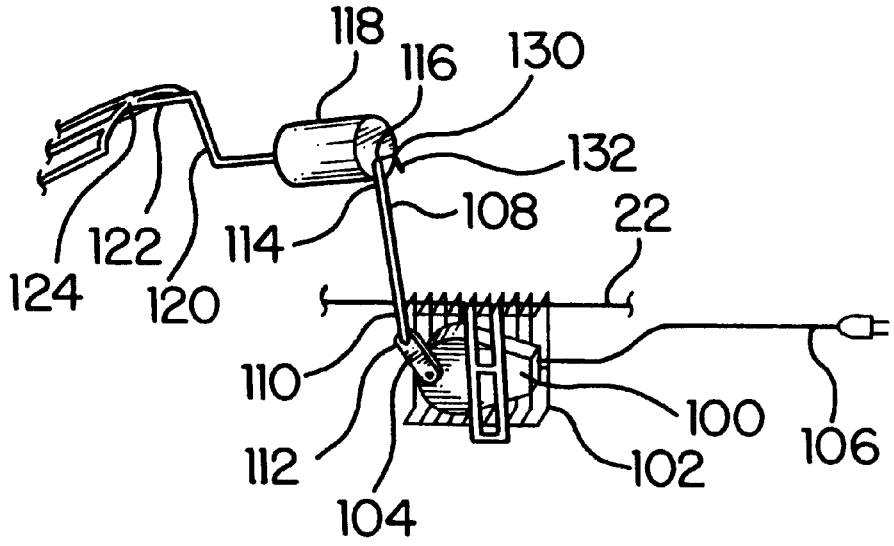
FIG. 3 is a fragmentary perspective view of the invention showing a detailed illustration of the motor and counterweight when the head and neck portion of the display is in a downward position, as shown in FIG. 1.
Figure 4:
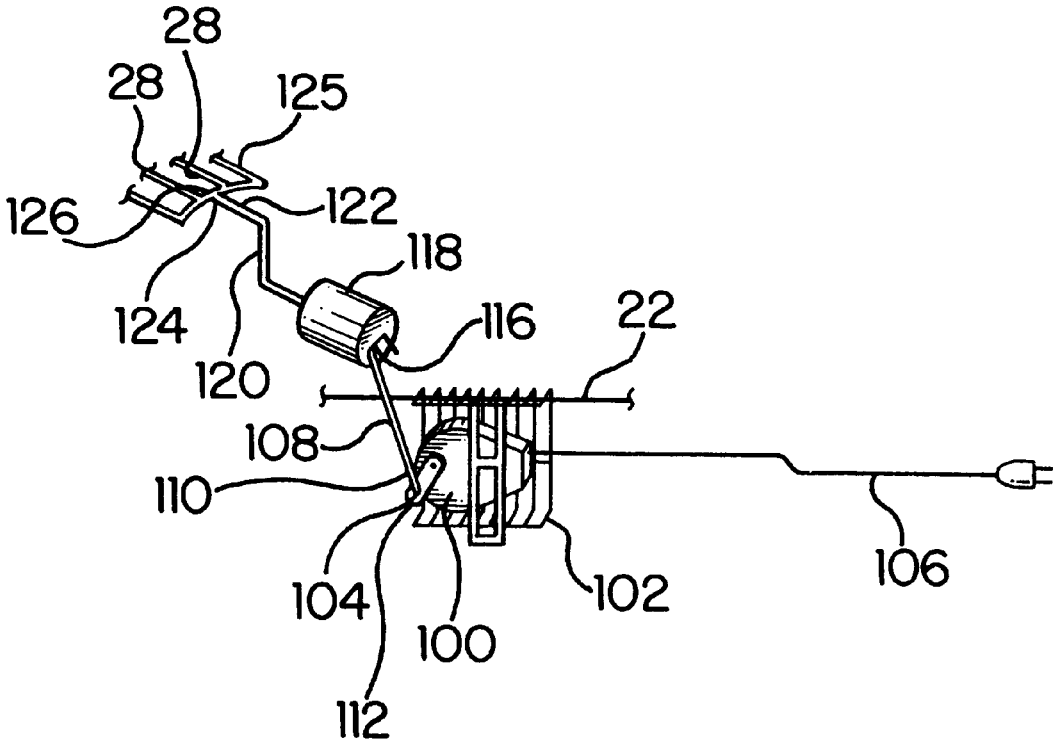
FIG. 4 is a fragmentary perspective view of the invention showing a detailed illustration of the motor and counterweight when the head and neck portion of the display is in an upward position, as shown in FIG. 2.

With reference now to the drawings, wherein like reference characters designate like or corresponding parts throughout the several views, there is shown animated wire framework and light supporting display 20 in the shape of a deer, including the head and neck portions 28 of a deer. Assembly 20 includes first and second wire frame assemblies 22, 24 defining lower and upper body portions of the deer, respectively. Second frame assembly 24 is hingedly connected to first frame assembly 22 by hinges 26, 26'. Third wire frame assembly 28, which defines the head and neck portions of the deer, is hingedly connected to first frame assembly 22 by hinges 30, 30' for movement of assembly 28 in a substantially up and down oscillatory manner.

Fourth wire frame assemblies or leg portions 32, 32', 33, 33' are connected to first wire frame assembly 22, as described and illustrated in U.S. Pat. No. 5,850,927.

In accordance with this invention, animation of wire framework display 20 is provided by mounting a conventional electrically powered motor 100 to first wire frame assembly 22, which is a lower body portion of a deer. Preferably, motor 100 is suspended beneath wire frame assembly 22 and is connected to assembly 22 by welding or other conventional means. A wire cage 102 preferably at least partially protectively surrounds motor 100, and cage 102 is conventionally attached to frame assembly 22, such as by welding or other similar conventional means.

Motor 100 includes a first arm 104 which extends from the motor and which rotates in response to activation of the motor by electricity. Motor 100 is connected to a conventional electrical source of power (not shown) by a conventional electrical cord 106.

A second, L-shaped arm 108 is rotatably attached at a first end 110 thereof to motor arm 104 by a pin 112.

Second end 114 of L-shaped arm 108 is rotatably positioned through first cylindrical receptacle 116, which is conventionally attached to a counterweight 118, such as by welding.

Counterweight 118 is located between wire frame assembly 22 and wire frame assembly 24 and a third arm member 120 is connected to counterweight 118, such as by welding.

Arm member 120 projects forwardly from counterweight 118 and forward, distal end 122 of arm member 120 is positioned within second cylindrical receptacle 124, which is conventionally attached, such as by welding, to a rearward and upper portion 125 of head and neck assembly portion 28.

Distal end 122 of arm member 120 defines an opening 126 therein, and a pin 128 is removably positioned through opening 126 to hold arm member 120 and distal end 122 of arm member 120 within cylindrical receptacle 124.

Similarly, second end 114 of arm 108 defines an opening 130 therein, and a pin 132 is removably positioned through opening 130 to hold end 114 of arm 108 within cylindrical receptacle 116.

Wire element 134 at the lower rear of neck portion 28 is angled forwardly to permit wire frame assembly 28, including the head and neck portions of the deer, to move up and down in an oscillating manner when motor 100 is activated.

In operation and use, electrical cord 106 is connected to a conventional electrical outlet (not shown) to energize motor 100. Energization of motor 100 causes motor arm 104 to rotate in a continuously circular manner. This, in turn, causes second, L-shaped arm 108 to move in a manner to change the rotating motion of motor arm 104 to an up and down oscillating motion imparted to counterweight 118. The up and down oscillating motion of counterweight 118, in turn, causes third wire frame assembly 28, including the head and neck portions of the deer, to move in a responsive oscillatory manner so that the head and neck portions of the deer move in an up and down manner. The head and neck portions of framework 20, as defined by third wire frame assembly 28, are rotated about hinges 30, 30' as the head and neck portions are oscillated in an up and down direction.

When it is desired to collapse or fold display 20 from its erected configuration, second wire frame assembly 24, which is the upper body portion of the deer, is opened by rotating frame assembly 24 upwardly and backwardly about hinges 26, 26'. This allows access to the interior of display 20, and pins 128, 132 are removed. Forward end 122 of arm member 120 can then be removed from cylindrical receptacle 124, and second end 114 of arm 108 can be removed from cylindrical receptacle 116. Counterweight 118 can then be removed.

Display 20 can then be collapsed or folded from its erected configuration into the compact folded configuration shown in FIG. 5 of U.S. Pat. No. 5,850,927 for storage or transport, and counterweight 118 can be packed or stored with the collapsed and folded display 20.

Arm member 120 is preferably generally Z-shaped in configuration, however, other shapes for arm member 120 could be used.

Electrical cord 106 is also preferably electrically connected in a conventional manner to conventional string lights, such as Christmas lights, (not shown) which can be quickly and easily removably attached to framework or display 20 in a conventional manner.

The invention in its broader aspects is not limited to the specific details shown and described, and departures may be made from such details without departing from the principles of the invention and without sacrificing its chief advantages.

What is claimed is:

1. An animated, collapsible, three-dimensional wire framework and light supporting display comprising:

a first wire frame assembly defining a first predetermined portion of a figure;

a second wire frame assembly defining a second predetermined portion of said figure, said second frame assembly hingedly connected to said first frame assembly for movement between a first open position and a second closed position in relationship with said first frame assembly;

a third wire frame assembly defining a third predetermined portion of said figure, said third frame assembly hingedly connected to said first frame assembly for movement between a first erected position and a second folded position;

said first and third frame assemblies sized and configured for enabling said first frame assembly to receive said third frame assembly at least partially within said first frame assembly when said third frame assembly is hingedly moved from said first erected position to said second folded position;

said first, second and third frame assemblies further sized and configured for enabling said second frame assembly to receive said third frame assembly at least partially within said second frame assembly when said second frame assembly is hingedly moved from said first open position to said second closed position while said third frame assembly is in said second folded position and is received at least partially within said first frame assembly;

at least one fourth wire frame support assembly defining a fourth predetermined portion of said figure, said fourth frame assembly connected to said first frame assembly;

a motor connected to said first wire frame assembly;

a first arm member connected to and extending from said motor for movement in response to activation of said motor;

a second arm member defining first and second ends, said first end rotatably attached to said first arm member;

a counterweight located between said first and second wire frame assemblies and having a first receptacle connected thereto;

said second end of said second arm member rotatably positioned within said first receptacle;

a third arm member attached to and projecting from said counterweight, said third arm member defining a distal end;

a second receptacle attached to said third wire frame assembly; and said distal end of said third arm member positioned within said second receptacle, whereby activation of said motor causes substantially up and down oscillating movement of said third wire frame assembly.

2. A framework and display as in claim 1 wherein said fourth frame assembly is hingedly connected to said first frame assembly for movement between a first erected position and a second folded position.

3. A framework and display as in claim 2 including a plurality of said fourth wire frame support assemblies, and wherein said fourth frame assemblies in said folded positions are located in side-by-side relationship with respect to each other.

4. A framework and display as in claim 1 wherein said second end of said second arm member is removably positioned within said first receptacle.

5. A framework and display as in claim 1 wherein said distal end of said third arm member is removably positioned within said second receptacle.

6. A framework and display as in claim 1 wherein said third arm member is substantially Z-shaped.

7. A framework and display as in claim 1 wherein said third wire frame assembly defines a rear portion sized and configured with respect to said first wire frame assembly and with said second wire frame assembly to permit substantially up and down oscillating movement of said additional wire frame assembly.

8. An animated, collapsible, three-dimensional wire framework and light supporting display comprising:

a first wire frame assembly defining a first predetermined portion of a figure;

a second wire frame assembly defining a second predetermined portion of said figure, said second frame assembly in operative relationship with said first frame assembly for movement between a first open position and a second closed position in relationship with said first frame assembly;

a third wire frame assembly defining a third predetermined portion of said figure, said third frame assembly in operative relationship with said first frame assembly for movement between a first erected position and a second folded position;

said first and third frame assemblies sized and configured for enabling said first frame assembly to receive said third frame assembly at least partially within said first frame assembly when said third frame assembly is moved from said first erected position to said second folded position;

said first, second and third frame assemblies further sized and configured for enabling said second frame assembly to receive said third frame assembly at least partially within said second frame assembly when said second frame assembly is moved from said first open position to said second closed position while said third frame assembly is in said second folded position and is received at least partially within said first frame assembly;

at least one fourth wire frame support assembly defining a fourth predetermined portion of said figure, said fourth frame assembly connected to said first frame assembly;

a motor connected to said first wire frame assembly;

a first arm member connected to and extending from said motor for movement in response to activation of said motor;

a second arm member defining first and second ends, said first end rotatably attached to said first arm member;

a counterweight located between said first and second wire frame assemblies and having a first receptacle connected thereto;

said second end of said second arm member rotatably positioned within said first receptacle;

a third arm member attached to and projecting from said counterweight, said third arm member defining a distal end;

a second receptacle attached to said third wire frame assembly; and said distal end of said third arm member positioned within said second receptacle, whereby activation of said motor causes substantially up and down oscillating movement of said third wire frame assembly.

9. A framework and display as in claim 8 wherein said fourth frame assembly is hingedly connected to said first frame assembly for movement between a first erected position and a second folded position.

10. A framework and display as in claim 9 including a plurality of said fourth wire frame support assemblies, and wherein said fourth frame assemblies in said folded positions are located in side-by-side relationship with respect to each other.

11. A framework and display as in claim 8 wherein said second end of said second arm member is removably positioned within said first receptacle.

12. A framework and display as in claim 8 wherein said distal end of said third arm member is removably positioned within said second receptacle.

13. A framework and display as in claim 8 wherein said third arm member is substantially Z-shaped.

14. A framework and display as in claim 8 wherein said third wire frame assembly defines a rear portion sized and configured with respect to said first wire frame assembly and with said second wire frame assembly to permit substantially up and down oscillating movement of said additional wire frame assembly.

* * * * *